United States Patent [19]

Atkinson

[11] 3,998,440

[45] Dec. 21, 1976

[54] FURNACE VESSELS

[75] Inventor: Donald Alan Atkinson, Stockton-on-Tees, England

[73] Assignee: Davy Ashmore International Limited, Stockton-on-Tees, England

[22] Filed: Oct. 31, 1975

[21] Appl. No.: 627,680

[30] Foreign Application Priority Data

June 13, 1975 United Kingdom ..... 25319/75

[52] U.S. Cl. ..... 266/245

[51] Int. Cl.[2] ..... C21C 5/50

[58] Field of Search ... 266/35, 36 P, 243, 245–247; 308/61, 72, 176; 75/59, 60

[56] References Cited

UNITED STATES PATENTS 3,364,773 1/1968 Falk ..... 266/36 P

FOREIGN PATENTS OR APPLICATIONS 42-29562 11/1967 Japan ..... 266/245

342,917 10/1971 U.S.S.R. ..... 266/245

229,560 10/1971 U.S.S.R. ..... 266/246

311,968 10/1971 U.S.S.R. ..... 266/245

*Primary Examiner*—Gerald A. Dost

*Attorney, Agent, or Firm*—Brisebois & Kruger

[57] ABSTRACT

A furnace vessel is supported by way of a pair of trunnion pins rotatably mounted in bearings on pedestal structures. To allow vibrations set up in the vessel in the direction parallel to the common axis of the trunnion pins to be absorbed, the pedestal structures are pivotably mounted on fixed supports so as to be pivotable about a pair of parallel axes spaced from and normal to the common axis of the trunnion pins, and at least one of the structures has damping means associated therewith by which movement of the structure and hence of the vessel can be absorbed.

5 Claims, 3 Drawing Figures

FURNACE VESSELS

Figure 1:
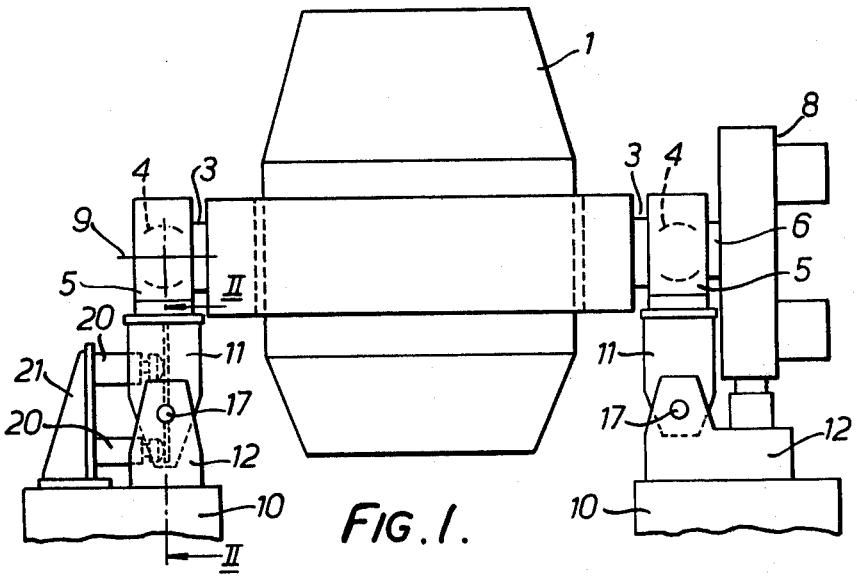

This invention relates to furnace vessels provided with a pair of diametrically opposed trunnion pins. Such vessels are well known in the Iron and Steel Industry where they are used as steel making or refining furnaces. The trunnion pins may be fixed directly onto the wall of the vessel but it is more usual for the trunnion pins to be mounted on a trunnion ring which fits around the vessel and to which the vessel is secured.

The hollow open ended furnace vessel is pivotable about a horizontal axis with its trunnion pins in bearings carried by pedestals mounted on rigid foundations. The normal operating position of the vessel is with its open end uppermost but when the vessel is to be charged or tapped the vessel is pivoted about the bearings in the horizontal plane.

When the furnace is in use, the process reactions which occur in the bath of molten metal contained within the vessel may set up vibrations in the vessel. These vibrations, if allowed to continue, can cause damage to the vessel itself and if they are particularly severe they can cause damage to the supporting structure of the vessel and to the foundation on which the supporting structure is mounted.

The vibrations emanating from the molten metal in the vessel will effectively act in three directions, either vertically, in a direction parallel to the common axis of the pair of trunnions, or normal to this direction. Vibrations in the latter direction can be satisfactorily absorbed by resilient torsion restraining devices usually supplied with the drive unit which serves to rotate the vessel.

The present invention is concerned with means by which vibrations in the direction parallel to the common axis of the trunnion pins can be absorbed.

According to the present invention a furnace vessel is provided with a pair of diametrically opposed trunnion pins each of which is rotatably mounted in a bearing carried by a separate pedestal structure, said structures being pivotable about respective parallel axes spaced from and normal to the axis of rotation of the trunnion pins and means are provided for damping pivotable movement of said pedestal structures about said axes.

The pedestal structures, the bearings, the trunnion pins and the vessel constitute a unit which is pivotable about said parallel axes and the damping means may be associated with one of the pedestal structures whereby pivotable movement of said unit is damped.

Preferably the parallel axes about which the structures are pivotable are horizontal and the pedestal structures are pivotable about horizontal shafts supporting by brackets rigidly secured to a foundation.

In use, the vibrations set up in the vessel and acting in the direction parallel to the axis of the trunnion pins are to a large extent absorbed by the damper means and thus greatly reduce the forces which are imparted to the furnace structure and the foundations.

Figure 3:
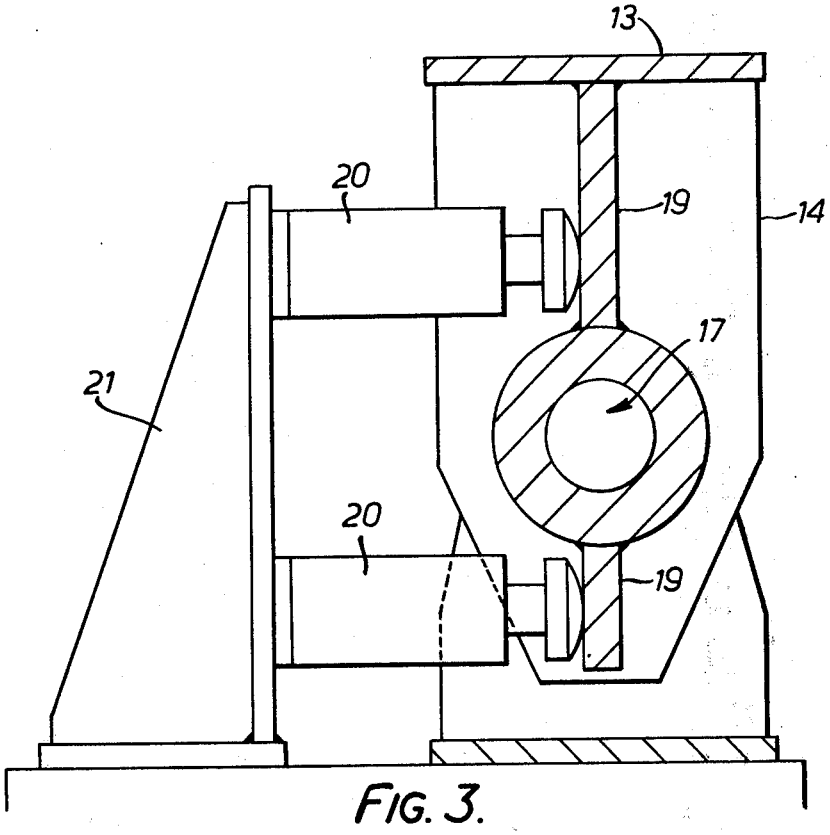
Figure 2:
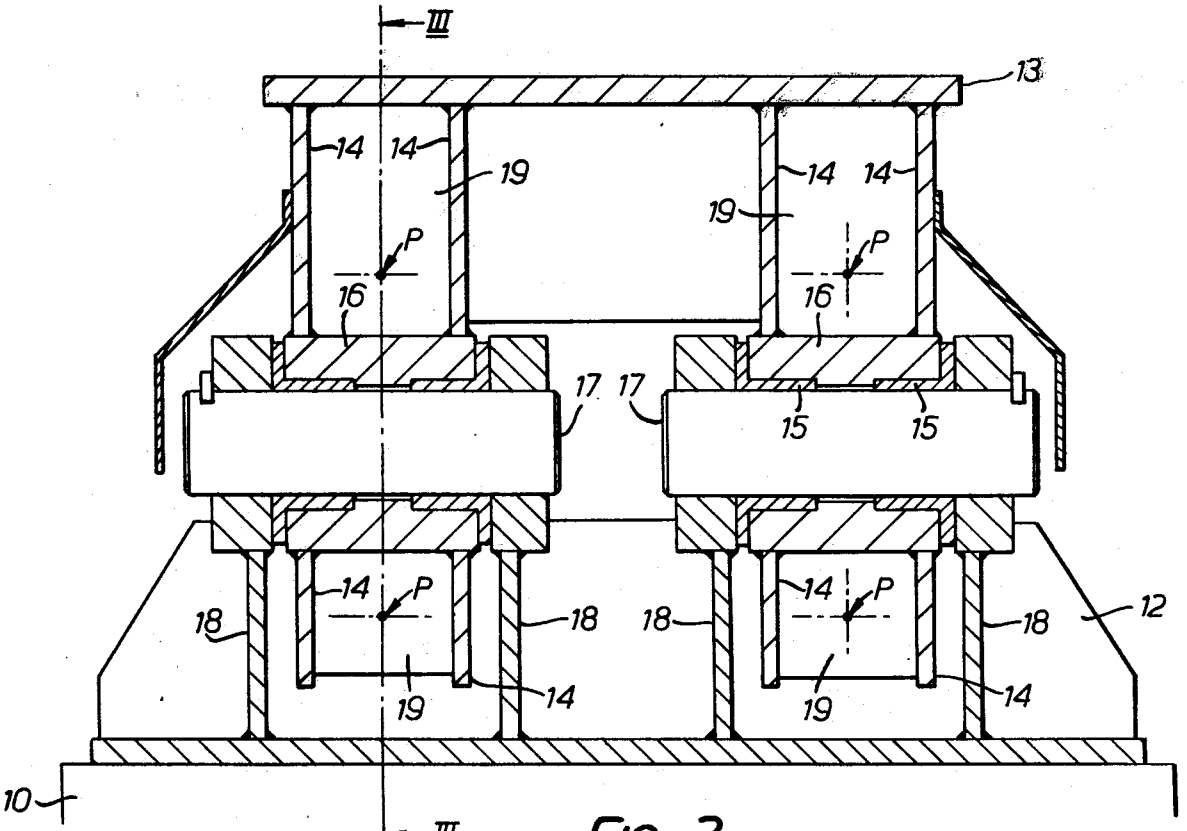

In order that the invention may be more readily understood it will now be described, by way of example only, with reference to the accompanying drawings in which:

FIG. 1 is a side elevation of a vessel according to the present invention and capable of containing a quantity of molten metal, FIG. 2 is a section on the line II—II of FIG. 1, and FIG. 3 is a section of the line III—III of FIG. 2.

Referring to FIG. 1 a furnace comprises a generally cylindrical vessel 1 open at its upper end and having a lining of refractory material. A trunnion ring 2 encircles the vessel and the vessel is secured to the ring by means not shown. The ring 2 is provided with a pair of diametrically opposed trunnion pins 3 which are supported in spherical bearings 4 contained in housings 5. An extension 6 of one of the trunnions to the side of the bearing 4 which is away from the vessel allows a tilting drive gear unit 8 to be secured to the extension of the trunnion. On operating the drive gear unit, the trunnions 3 are rotated in the bearings 4 causing the ring 2 to pivot, carrying the vessel 1 with it. The vessel is thus pivotable about that axis which is the axis of rotation 9 of the trunnions with respect to the bearings.

In use, when molten metal is contained in the vessel and process reaction take place, vibrations are set up and some of these vibrations are in a direction parallel to the axis 9 of the trunnions. If steps are not taken to damp out these vibrations, damage can be caused to the vessel, the ring and to the bearings 4 and also to the foundation 10 on which the bearings are indirectly supported.

The present invention seeks to provide means for resiliently absorbing all of the vibrations in the direction parallel to the axis of rotation of the trunnions and to this end the bearings 4 in their housing 5 are carried by separate pedestal structures 11 which are pivotable with respect to support brackets 12 rigidly mounted on the foundation 10. The support structures are pivotable about respective parallel axes which are spaced from, and extend normal to, the axis of rotation 9 of the trunnions.

The trunnion ring 2, the self-aligning bearings 4 and the pivotally mounted pedestal structures 11 effectively form a jointed four bar frame which is of rectangular form but which under the effect of the axial vibration forces can deflect into a parallelogram. Damping means are associated with the four bar frame to retain the four bar frame in its rectangular form. One of the pedestal structures 11 is shown in more detail in FIG. 2. The bearing housing 5 is secured to a plate 13 having two pairs of further plates 14 welded at right angles thereto. A pair of bushes 15 is secured in coaxial blocks 16 formed in each pair of further plates. Each pair of bushes has a pivot pin 17 freely rotatable therein and each pivot pin is carried by a pair of support plates 18 forming part of the bracket 12. The further plates 14 have a plate 19 secured to them, the plane of the plate 19 being normal to the plane of the plates 14. The pedestal structure 11 on one side of the vessel, and preferably that side which is remote from the tilting drive gear unit, has damping means associated therewith. The damping means comprise a pair of dampers 20 positioned one above the other and supported by a frame 21 secured on the foundation 10. Each damper includes a spring loaded piston and the two pistons of the devices engage with the plate 19 at positions above and below the longitudinal axis of the pivot pins 17. The points of engagement between the heads of the pistons and the plates 19 are indicated by reference numerals P in FIG. 2.

The energy dampers 20 are preferably of a design similar to buffers on railway rolling stock and which contain springs which are compressed by the plate 19 as the pedestal unit pivots about the pins 17. As the structure pivots about the pins the dampers dissipate the energy which is applied to compress the springs as it is undesirable for this energy to be restored to the system when the exciting force which originally caused the pivoting motion has been removed. If this was not the case it is likely that a rocking motion would be set up. Suitable overrun stops are provided, that are not shown, to prevent undue rotation of the pedestal structure on the event of failure of one or both of the dampers 20.

Alternatively the energy dampers 20 may include rubber blocks to absorb the energy in a similar manner to the rubber blocks employed in automatic couplers of railway stock.

What I claim is:

1. A furnace vessel having a pair of trunnion pins projecting from opposite sides thereof, a pair of pedestal structures each carrying a bearing, said trunnion pins rotatably mounted in the bearings, a pair of spaced vertical supports including a pair of pins defining parallel axes spaced from and perpendicular to the axes of rotation of the trunnion pins, said pedestal structures pivotally mounted on said pins, damping means on one of said vertical supports and engageable with one of the pedestal structures to damp pivotable movement of said pedestal structure about said axes.

2. A furnace vessel as claimed in claim 1 in which said supports each comprise a pair of brackets secured to a rigid foundation and pivot pin carried by the brackets.

3. A furnace vessel as claimed in claim 1 in which said damping means comprise a pair of dampers arranged one above the other and engageable with the pedestal structure above and below the pivotable axis thereof respectively.

4. A furnace vessel as claimed in claim 3 wherein each damper includes at least one coil spring.

5. A furnace comprising a generally cylindrical vessel open at one end, a trunnion ring encircling the vessel and secured thereto, a pair of trunnion pins projecting in diametrically opposed relation from said ring, a pair of pedestal structures each carrying a bearing, said trunnion pins being rotatably mounted in the bearings, a pair of vertical supports each comprising a pair of brackets secured to a rigid foundation and a pivot pin carried by each of the brackets, said pivot pins having longitudinal axes arranged mutually parallel and perpendicular to the axes of rotation of the trunnion pins in said bearings, said structures being pivotably mounted on said pivot pins and a pair of dampers arranged one above the other engageable with one of said structures above and below the pivotable axis thereof respectively.

* * * * *